United States Patent [19]

Mascia et al.

[11] 4,147,283

[45] Apr. 3, 1979

[54] COMBINED CHARGING AND PRODUCT DISPENSING UNIT

[75] Inventors: Carmen T. Mascia, Clarendon Hills; Gary K. Hasegawa, Chicago, both of Ill.

[73] Assignee: The Continental Group, Inc., New York, N.Y.

[21] Appl. No.: 835,241

[22] Filed: Sep. 21, 1977

[51] Int. Cl.[2] ..... B05B 9/04; B65D 83/14

[52] U.S. Cl. ..... 222/399; 239/308

[58] Field of Search ..... 239/307, 308, 373; 222/394, 399, 402.1, 402.24; 169/85, 88; 141/14, 17, 19

[56] References Cited

U.S. PATENT DOCUMENTS

| | | | |
|---|---|---|---|
| 938,517 | 11/1909 | Schmitt | 222/399 |
| 1,412,321 | 4/1922 | Tate | 222/399 |
| 2,385,449 | 9/1945 | Koehler | 169/85 X |
| 2,559,634 | 7/1951 | Keefe, Jr. et al. | 169/85 X |
| 2,973,885 | 3/1961 | Ferguson | 222/399 |

*Primary Examiner*—David A. Scherbel

*Attorney, Agent, or Firm*—Charles E. Brown

[57] ABSTRACT

A combined charging and product dispensing unit is provided for reception in the mouth of a container in sealed relation with the unit, including a valve body having a container of liquid gas carried thereby. The valve body is provided with a valve assembly for manually controlling the flow of gas under pressure out through the valve body into the container to pressurize the interior of the container. The unit also includes a discharge tube which is connected to a discharge nozzle carried by an actuator for the valve unit.

7 Claims, 2 Drawing Figures

COMBINED CHARGING AND PRODUCT DISPENSING UNIT

This invention relates in general to new and useful improvements in containers of the dispensing type, and more particularly to containers wherein fluid products may be dispensed therefrom by merely pressing on an actuator.

Dispensing containers of the aerosol type are well known and the prior art is well developed with respect thereto. However, the dispensing containers utilize as propellants gases such as Freon which are damaging the atmosphere, and as a result there must be a change in the dispensing concept for environmental purposes.

In accordance with this invention, there is provided a unit which is mountable within a container for effecting the dispensing of a fluid product therefrom, the unit being self-contained and including means for periodically charging a container and means for facilitating the flow of the product from the container when charged.

Most specifically, in accordance with this invention there is provided a combined charging and dispensing unit which has formed as part thereof a liquid gas supply and a valve for communicating the gas supply with the interior of the container only when it is desired to dispense a portion of the packaged product.

Another feature of the invention is that the combined charging and dispensing unit includes the usual pick-up tube which extends down into the bottom of the container and which pick-up tube is in constant communication with a discharge nozzle, whereby the packaged product is dispensed in accordance with the periodical charging of the container.

Another feature of the invention is that the combined charging and dispensing unit includes an actuator which functions as a carrier for the discharge nozzle with the actuator being supported by a valve element and by a stem portion carrying the discharge tube so that the actuator may be readily depressed to dispense a product and is readily returned to valve closing position.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
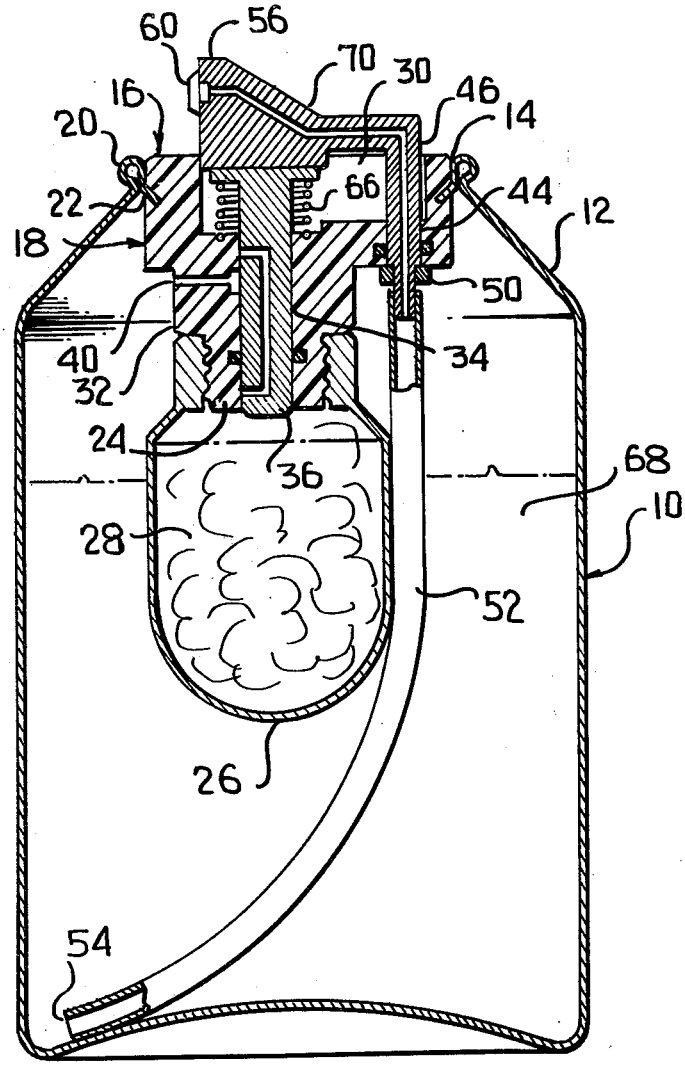
FIG. 1 is a sectional view taken through a container having mounted therein the combined charging and dispensing unit.
Figure 2:
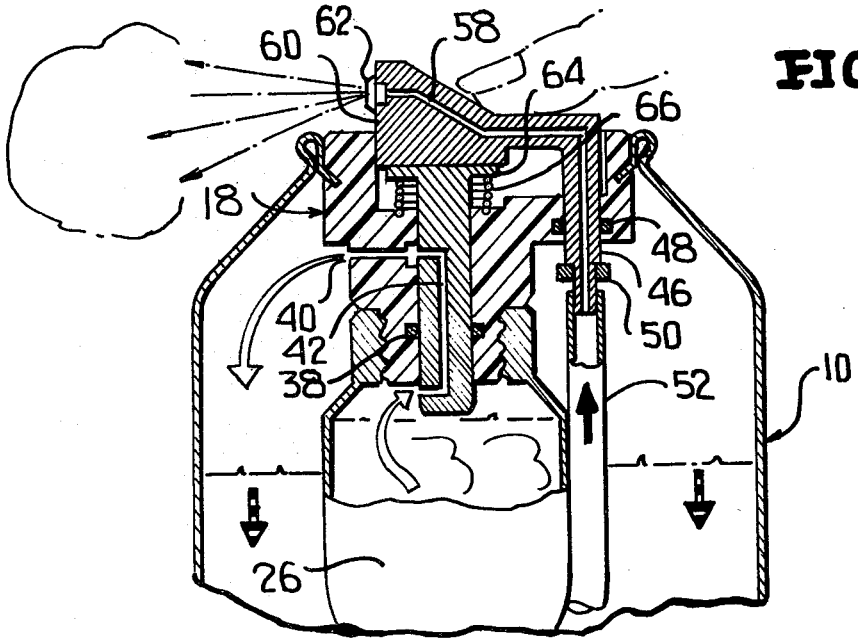
FIG. 2 is an enlarged sectional view showing more specifically the details of the unit with the unit in its operative position dispensing a product.

Referring now to the drawings in more detail, it will be seen that there is illustrated in FIG. 1 a conventional container 10 which may be of any construction but preferably is in the form of a can having a conical upper portion 12 with a circular mouth 14. Positioned within the mouth 14 and closing the same is a combined charging and dispensing unit formed in accordance with this invention and generally identified by the numeral 16.

The unit 16 includes a valve body 18 which is generally in the form of a plug and which may be conventionally molded of readily available materials such as plastics materials. The valve body may be sealed to the container 10 in any desired manner, although securement thereof is by way of a beaded member 20 having a flange 22 embedded in the periphery of the upper portion of the valve body 18.

The lower part of the valve body 18 is in the form of an externally threaded plug 24 which has removably threaded therein a container 26 for a gas under pressure. The gas is preferably supplied in the form of liquid gas and is identified by the numeral 28.

The valve body 18 is provided with an upper recess 30 which is disposed in offset relation to the center of the upper part of the valve body. The valve body 18 also includes an intermediate part 32 which is offset with respect to the upper part and is provided with a circular bore 34 which is generally disposed concentric to the plug portion 24 and opens through the lower end of the plug portion and into the recess 30. The bore 34 has slidably mounted therein for axial movement a rod-like valve element 36 which has its lower end in constant communication with the interior of the gas container 26. The bore 34 is sealed around the valve element 36 by means of an O-ring 38.

The intermediate portion 32 of the valve body 18 is provided with a gas outlet 40. The gas outlet 40 opens from the bore 34 exteriorly of the valve body 18.

The valve element 36 has formed therein a generally horizontally extending generally C-shaped passage 42 which normally is out of communication with both the gas container 26 and the outlet 40. However, when the valve element 36 is depressed, the passage 42 will have the lower end thereof open to the interior of the gas container 26 and the upper end thereof in communication with the outlet 40 so that gas under pressure may be discharged from the gas container 26 into the container 10 and thus temporarily charge the container 10.

Offset from the bore 34 and parallel thereto is a bore 44 which extends from within the recess 30 through the upper portion of the valve body 18 into the interior of the container 10. Slidably guided within the bore 44 is a stem portion 46. The stem portion 46 is sealed relative to the valve body 18 by means of an O-ring 48 while permitting reciprocatory movement of the stem portion 46 through the valve body 18. The lower part of the stem portion 46 is provided with an annular enlargement 50 which is engageable with the underside of the valve body upper portion to function as a stop limiting the upward movement of the stem portion 46. The enlargement 50 also serves to function as a stop for an upper end of a dispensing tube 52 which is telescoped over the lower end of the stem portion and extends down into the container 10. The tube 52 has an entrance opening 54 which is always disposed adjacent the bottom of the container 10.

It is to be noted that the stem portion 46 is integrally formed with an actuator 56. The actuator 56 is disposed in overlying relation with respect to the recess 30 and is movable down thereinto under pressure. The actuator 56 and the stem portion 46 have a dispensing passage 58 therethrough terminating in a dispensing nozzle 60 disposed in a front face 62 of the actuator.

It is to be noted that the valve element 36 has an enlarged upper head 64 on which the actuator 56 rests. If necessary, the head 64 could be fixedly connected to the underside of the actuator 56. Further, it is to be noted that the upper portion of the valve element 36 is surrounded by a coil spring 66 which underlies the head 64 and constantly urges the valve element 36 to a retracted valve closing position.

OPERATION

Referring to FIG. 1, it will be seen that the valve element 36 is normally retained in its closed position by the spring 66 assisted by the gas pressure on the lower end of the valve element. In this condition, although the dispensing nozzle 60 is always in direct communication with the interior of the container 10 and the product stored therein, there is no discharge of the product. However, when the actuator 56 is depressed, the valve element 36 is moved downwardly so as to place the opposite ends of the valve passage 42 in communication with the interior of the gas container 26 and with the gas outlet 40. Gas immediately flows out of the gas container 26 into the interior of the container 10, internally pressurizing the same. The gas pressure within the container 10 then forces the product stored therein, the product being identified by the numeral 68, up through the tube 52 and out through the dispensing nozzle 60. It will be readily apparent that the quantity of the product 68 dispensed will be directly proportional to the gas supplied to the interior of the container 10.

At this time it is pointed out that the actuator 56 has an upper surface particularly configurated so as to define an area 70 where one's finger may be conveniently engaged therewith so as to facilitate the depressing of the actuator. This area 70 is disposed between the valve element 36 and the stem portion 46 so as generally to eliminate any force which would tend to cock the actuator 56 and jam the same against movement. It is to be understood that the valve element 36, even when it is not fixedly secured to the actuator 56, will function as a support for the actuator 56 as does the stem portion 46.

It is envisioned that the combined charging and dispensing unit 16 could be reusable and if so, the upper portion of the valve body will be so constructed whereby it could snap onto or otherwise be removably secured to the mouth of a container. It is also to be understood that the gas container 26 may also be of the interchangeable type, although it is possible that one gas container 26 may contain sufficient gas to dispense the products of several containers.

Although only a preferred embodiment of the charging and dispensing unit has been specifically illustrated and described herein, it is to be understood that minor variations may be made therein without departing from the spirit and scope of the invention as defined by the appended claims.

What is claimed as new is:

1. A combined charging and product dispensing unit comprising a valve body, mounting means on said valve body for mounting said valve body within a container, attaching means carried by said valve body for securing a container of pressurized gas to said valve body, a gas outlet in said valve body, a valve member having a gas passage therethrough for simultaneous communication with the interior of a gas container and said gas outlet, an actuator connected to said valve member for moving said valve member to a position communicating an associated gas container with said gas outlet, a product discharge tube dispensing from said valve body for receiving a fluid product to be dispensed, and a discharge nozzle in communication with said discharge tube for receiving a product from said tube, said discharge nozzle being formed in said actuator, said actuator including a stem portion connected to said tube, said valve body having an opening receiving said stem portion, and cooperating sealing means on said valve body and said stem portion for sealing said opening while permitting movement of said stem portion through said valve body.

2. The unit of claim 1 wherein said opening is elongated and closely fits said stem portion to form a guided support for said actuator.

3. The unit of claim 2 wherein said valve member is of a rod-like construction and is guided in said valve body, said valve element underlying said actuator and forming a support therefor.

4. The unit of claim 3 wherein said actuator has a depressing area located between said valve member and said stem portion.

5. The unit of claim 1 wherein a resilient member constantly urges said actuator to a closed position of said valve member, and said stem portion and said valve body have cooperating stop surfaces limiting movement of said actuator by said resilient member.

6. A combined charging and product dispensing unit comprising a valve body, mounting means on said valve body for mounting said valve body within a container, attaching means carried by said valve body for securing a container of pressurized gas to said valve body, a gas outlet in said valve body, a valve member having a gas passage therethrough for simultaneous communication with the interior of a gas container and said gas outlet, an actuator connected to said valve member for moving said valve member to a position communicating an associated gas container with said gas outlet, a product discharge tube depending from said valve body for extending into and receiving a fluid product to be dispensed, and a discharge nozzle in communication with said discharge tube for receiving a product from said tube, said discharge nozzle being in constant communication with said discharge tube and carrying said discharge tube.

7. The unit of claim 6 wherein said valve body has an upper portion in the form of a plug for reception in a container mouth reduced in size as compared to the container cross section, and all of said unit lies within an axial projection of the outline of said plug.

* * * * *